US007669811B2

(12) United States Patent
Williamson et al.

(10) Patent No.: US 7,669,811 B2
(45) Date of Patent: Mar. 2, 2010

(54) DISPLAY HOLDER FOR A TUBULAR CYLINDRICAL ROLL

(75) Inventors: Peter John Williamson, Etobicoke (CA); Randall Thomas Garbaty, Keysville, GA (US)

(73) Assignee: The Evercare Company, Alpharetta, GA (US)

( * ) Notice: Subject to any disclaimer, the term of this patent is extended or adjusted under 35 U.S.C. 154(b) by 814 days.

(21) Appl. No.: 10/985,408

(22) Filed: Nov. 10, 2004

(65) Prior Publication Data

US 2006/0097119 A1 May 11, 2006

(51) Int. Cl.
*A47G 23/02* (2006.01)

(52) U.S. Cl. ..... 248/152; 248/459; 248/150; 248/309.1; 206/395

(58) Field of Classification Search ..... 248/459, 248/150, 152, 309.1
See application file for complete search history.

(56) References Cited

U.S. PATENT DOCUMENTS

| | | | | | |
|---|---|---|---|---|---|
| 1,132,629 | A * | 3/1915 | Springman | ..... | 248/459 |
| 1,207,604 | A * | 12/1916 | Morgan | ..... | 248/152 |
| 1,247,275 | A * | 11/1917 | Hunziker | ..... | 248/459 |
| 1,399,507 | A * | 12/1921 | Mills, Jr. | ..... | 248/459 |
| 1,458,170 | A * | 6/1923 | Dietsche, Jr. | ..... | 248/152 |
| 1,657,381 | A * | 1/1928 | Everson | ..... | 248/152 |
| 1,699,875 | A * | 1/1929 | Burgess | ..... | 248/152 |
| 1,765,010 | A * | 6/1930 | Gross | ..... | 248/459 |
| 1,822,297 | A * | 9/1931 | Kemery | ..... | 211/33 |
| 2,142,826 | A * | 1/1939 | Rosello | ..... | 248/174 |
| 3,241,660 | A * | 3/1966 | Cathcart, Jr. et al. | ..... | 206/780 |
| 4,026,220 | A * | 5/1977 | Schuring, Jr. | ..... | 108/101 |
| 5,042,760 | A * | 8/1991 | Boschetto | ..... | 248/174 |
| 5,048,677 | A * | 9/1991 | Pedracine | ..... | 206/573 |
| 5,055,311 | A * | 10/1991 | Brauer et al. | ..... | 426/82 |
| 5,154,392 | A * | 10/1992 | Voight | ..... | 248/558 |
| 5,316,250 | A * | 5/1994 | Mason et al. | ..... | 248/165 |
| 6,116,553 | A * | 9/2000 | McKee | ..... | 248/174 |
| 6,234,433 | B1 * | 5/2001 | Maglione | ..... | 248/174 |
| 6,481,685 | B1 * | 11/2002 | Cormier | ..... | 248/311.3 |
| 7,451,873 | B2 * | 11/2008 | Chow et al. | ..... | 206/395 |
| 2006/0016707 | A1 * | 1/2006 | Chow et al. | ..... | 206/395 |

* cited by examiner

*Primary Examiner*—J. Allen Shriver, II
*Assistant Examiner*—Michael McDuffie
(74) *Attorney, Agent, or Firm*—Glifford, Krass, Sprinkle, Anderson & Citkowski, P.C.

(57) ABSTRACT

A display holder for a tubular cylindrical roll, such as a lint roller. The holder includes a planar main section constructed of a flexible material as well as a roll support which is pivotally mounted to the lower end of the main body between an operable position and a collapsed position. In its operable position, the roll support extends outwardly from the main body and supports the lower end of a roll inserted over the main body. Conversely, in its collapsed position, the roll support folds flatly against the main body for shipping and high density packing.

9 Claims, 2 Drawing Sheets

DISPLAY HOLDER FOR A TUBULAR CYLINDRICAL ROLL

BACKGROUND OF THE INVENTION

I. Field of the Invention

The present invention relates generally to display holders and, more particularly, to a display holder for a tubular cylindrical roll.

II. Description of the Related Art

Lint roller assemblies of the type used to remove detritus from clothing, furniture, floors and similar surfaces typically comprise a tubular and cylindrical adhesive roll which is rotatably mounted on a handle or other roller support. The adhesive roll itself comprises an elongated strip having adhesive on one side and which is wound into the tubular and cylindrical shape such that the adhesive faces outwardly.

The adhesive roll itself comprises a plurality of overlapping sheets on the wound cylindrical roll. After the adhesive on the outermost sheet becomes spent through usage, the outermost sheet is then removed from the roll thus exposing the next underlying sheet with fresh adhesive and enabling continued use of the lint roller assembly to remove detritus.

Ultimately, all of the sheets in the adhesive roll are used thus requiring replacement of the roll. The holder of the lint roller assembly, however, is reusable. Consequently, it has been the conventional practice to sell replacement adhesive rolls for lint roller assemblies individually for use with the lint roller handle. Thus replacement adhesive rolls are sold in many consumer retail establishments.

Many retail establishments require that the replacement adhesive rolls be packaged with display devices which can be suspended on hooks at the retail establishment. In order to accommodate this, there have been previously known cardboard display devices of the type shown in FIG. 7.

With reference then to FIG. 7, one prior art display device 10 is shown and includes an elongated planar main body 12 having a longitudinal length greater than the axial length of the replacement adhesive roll to be displayed. A hook opening 14 is formed through the main body 12 adjacent its upper end so that the display device 12 can be hung from a hook in a retail establishment.

A roll support 16 extends laterally outwardly from a lower end of the main body 12. This roll support 16, furthermore, includes a pair of laterally outwardly extending support tabs 18 which support a lower end of the replacement adhesive roll positioned over the main body 12.

The roll support 16 and main body 12 are typically of a one-piece cardboard construction. In order to assemble the roll support 16 such that it protrudes outwardly from the main body in the desired fashion, the roll support includes an attachment tab 20 at its free end. This attachment tab 20 is positioned behind two locking tabs 22 formed on the main body 12. Consequently, with the attachment tab 20 positioned behind the two locking tabs 22 as shown in FIG. 7, the support tabs 18 extend laterally outwardly from the main body and support the lower end of a replacement adhesive roll inserted over the top of the main body 12.

The prior art display device 10 shown in FIG. 7 is typically constructed from a one-piece cardboard blank. Consequently, in order to assemble the display device 10 so that it can be used to hold a replacement adhesive roll, it has been previously necessary to manually bend the locking tabs 22 on the main body to the position shown in FIG. 7 and then fold the roll support 16 to position the attachment tabs 20 behind the locking tabs 22. Such manual assembly of the prior art display device 10 necessarily increases the labor cost, and thus the overall cost, of the display device 10.

SUMMARY OF THE PRESENT INVENTION

The present invention provides a display device for a tubular cylindrical roll, such as a lint roller, which overcomes all of the above-mentioned disadvantages of the previously known devices.

The display holder of the present invention comprises a planar main body constructed of a flexible material and having an upper and a lower end. These ends are spaced apart from each other by a distance greater than the predetermined axial length of the roll to be mounted on the display holder.

A roll support is pivotally attached by a fold line to the lower end of the main body. The roll support includes a first section which extends between the main body and a second section which is secured at one end to the first section of the roll support and is fixedly attached at its other end to the main body at a position intermediate its ends. This roll support, furthermore, is pivotal between an operative position, in which the roll support extends laterally outwardly from the main body, and a collapsed position, in which the roll support is collapsed and flatly abuts against the main body.

At least one support tab on the roll support first section has a width greater than the predetermined inside diameter of the roll. Similarly, the main body includes at least one outwardly extending tab adjacent its upper end which has a width greater than the inside diameter of the cylindrical roll.

In order to assemble the adhesive roll onto the display device, the main body is slightly folded along a longitudinal center line to allow insertion of the upper end of the main body into and through the interior of the adhesive roll. During such insertion, the adhesive roll contacts the roll support tabs thus pivoting the roll support from its collapsed and to its operative position. Upon full insertion of the adhesive roll onto the main body, the outwardly extending tabs in the main body are positioned over the top of the roll thus locking the roll in between the locking tabs on the main body and the support tabs on the roll support.

A primary advantage of the present invention is that no manual assembly of the display holder is required. Instead, the cutting of the blank for the display holder, as well as the attachment of the free end of the roll support to the main body of the display holder, may be easily machine constructed.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
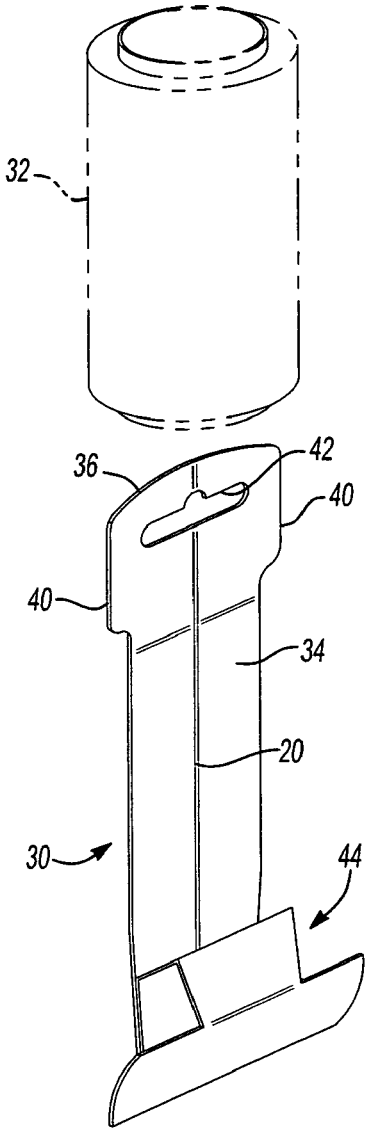
FIG. 1 is an elevational view illustrating a preferred embodiment of the display holder of the present invention prior to insertion of a cylindrical roll onto the holder.
Figure 3:
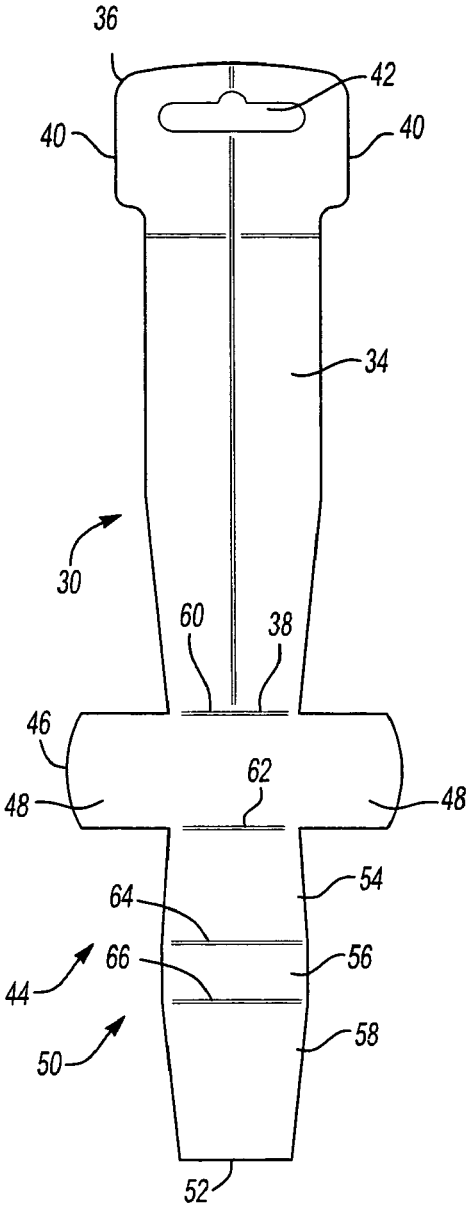
FIG. 3 is a plan view illustrating a blank used to form the display holder.

With reference first to FIGS. 1 and 3, a preferred embodiment of a display holder 30 of the present invention is shown. The display holder 30 is used in conjunction with a tubular cylindrical roll 32 having a predetermined axial length as well as a predetermined inside diameter. Although the tubular cylindrical roll 32 may be of any type, in the preferred embodiment it comprises a replacement adhesive lint roll.

The display device 30 includes an elongated planar main body 34 having an upper end 36 and a lower end 38. The main body 34 preferably has a width less than the inside diameter of the adhesive roll 32 for at least the axial length of the roll 32.

Still referring to FIGS. 1 and 3, at least one and preferably two tabs 40 extend outwardly from and are coplanar with the main body 34 adjacent its upper end 36. The tabs 40, furthermore, are dimensioned so that the width between the outer sides of the tabs 40 is greater than the inside diameter of the roll 32. Additionally, a hook opening 42 is preferably formed through the main body 34 just below its upper end 36.

Figure 2:
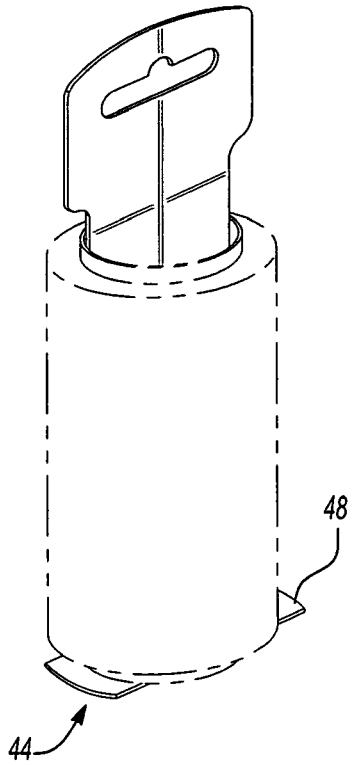
FIG. 2 is a view similar to FIG. 1, but illustrating a cylindrical roll mounted onto the display holder.

With reference now to FIGS. 1-4, a roll support 44 is attached to the lower end 38 of the main body 34. The roll support 44 includes a first section 46 immediately adjacent the lower end 38 of the main body 34. This first section 46, furthermore, has at least one, and preferably two roll support tabs 48 which together have a width greater than the inside diameter of the roll 32 as best seen in FIG. 2.

As best seen in FIG. 3, the roll support 44 further includes a second section 50 which extends outwardly from the first section 46 and terminates at a free end 52. The second section 50 of the roll support 44 includes three aligned parts 54, 56 and 58, each of which has a width less than the inside diameter of the roll 32.

The main body 34 and roll support 44 are preferably of a one-piece construction and are made from a flexible material, such as cardboard. A first crease or fold line 60 is formed laterally between the lower end 38 of the main body 34 and the roll support 44 which enables the roll support 44 to be pivotally mounted relative to the main body 34 about the fold line 60. Similarly, a laterally extending crease or fold line 62 is formed between the first section 46 of the roll support 44 and the second section 50. Likewise, additional creases or fold lines 64 and 66 are formed between the parts 54, 56 and 58 of the roll support second section 50. All of the fold lines 60, 62, 64 and 66 are generally parallel to each other.

Figure 4:
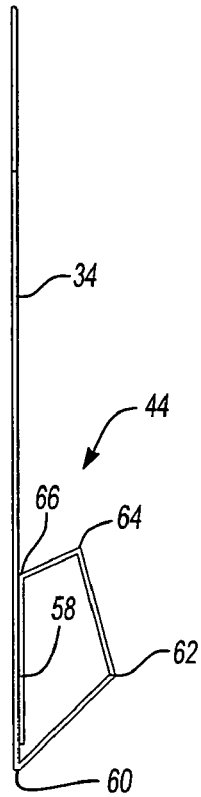
FIG. 4 is a side view of the preferred embodiment of the present invention in the operative position.

With reference now particularly to FIG. 4, the roll support 44 is bent about the fold lines 60-66 until the part 58 of the second section 50 abuts against the main body 34 adjacent its lower end 38. The part 58 is then fixedly attached to the main body 34 in any conventional fashion, such as by glue. Furthermore, the attachment of the second section part 58 of the roll support second section 50 can be accomplished by machine.

Figure 6:
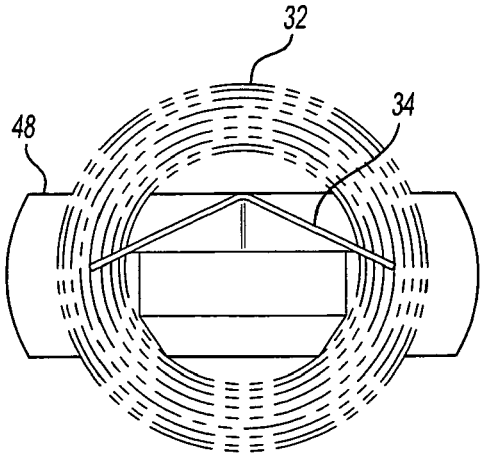
FIG. 6 is a view similar to FIG. 5, but illustrating the display holder following insertion of the cylindrical roll onto the holder.
Figure 4A:
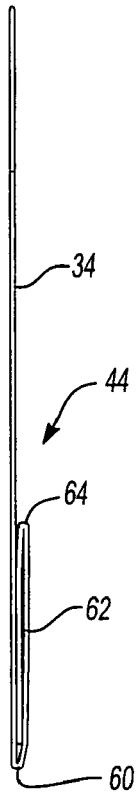
FIG. 4A is a view similar to FIG. 4, but showing the display holder in a collapsed position.

With the second section end part 58 attached to the main body 34 as previously described, the first section 46, second section 50, and a portion of the main body 34 from a collapsible loop and the roll support 44 is pivotal between an operable position, illustrated in FIGS. 2, 4 and 6, and a collapsed position, illustrated in FIG. 4A. In its operable position, the roll support 44 extends laterally outwardly from the main body 34 such that the tabs 46 on the roll support 44 engage and support the bottom end of the adhesive roll 32 once inserted onto the display device 30. Conversely, in its collapsed position as illustrated in FIG. 4A, the roll support 44 flatly abuts against the main body 34 for high density packing and shipping prior to use.

Figure 5:
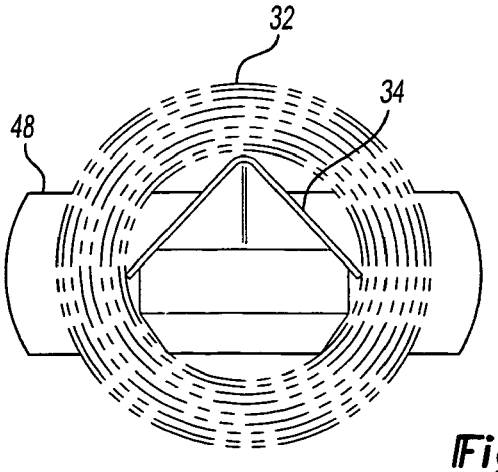
FIG. 5 is a top view illustrating the preferred embodiment of the display holder during insertion of a cylindrical roll onto the holder.
Figure 7:
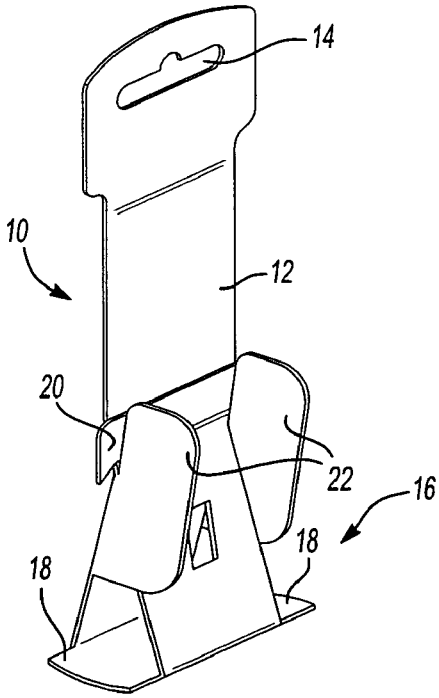
Fig-7 PRIOR ART
FIG. 7 is an elevational view of a prior art display holder.

With reference now to FIGS. 1, 6 and 7, in order to mount the roll 32 onto the holder 30, the main body 34 is first bent longitudinally to the position shown in FIG. 5 such that the tabs 40 on the main body 34 will fit inside the inside diameter of the roll 32. A longitudinally extending crease or fold line 70 (FIG. 1) is preferably formed along the main body 34 to facilitate such flexing of the main body 34.

Just prior to complete insertion of the roll 32 onto the holder 30, the bottom of the roll 32 engages the tabs 18 on the roll support 44 thus pivoting the roll support 44 from its collapsed or near-collapsed position (FIG. 4A) and to its operable position illustrated in FIGS. 2 and 6. Furthermore, upon complete insertion of the main body 34 through the roll 32, the tabs 40 on the main body 34 flex back to their original position as shown in FIGS. 2 and 6, thus locking the roll 32 between the tabs 40 on the main body 34 and the support tabs 18 on the roll support 44.

From the foregoing, it can be seen that the present invention provides a simple and yet highly effective display device for a tubular cylindrical roll, such as an adhesive lint roll, which may be rapidly inserted into the roll and without any need for manual preassembly of the holder. Having described my invention, however, many modifications thereto will become apparent to those skilled in the art to which it pertains without deviation from the spirit of the invention as defined by the scope of the appended claims.

We claim:

1. A display holder for a tubular cylindrical roll comprising:

an elongated planar main body constructed of a flexible material, said main body having an upper end and a lower end, said ends being spaced apart from each other, a roll support having a first section which extends laterally outwardly from said lower end of said main body and a second section extending upwardly from said first section and having a free end fixedly secured to said main body at a position intermediate said ends of said main body so that said first section, said second section and a portion of said main body form a collapsible loop, said main body having at least one outwardly extending tab adjacent said upper end of said main body, said at least one tab being spaced from said lower end of said main body, wherein said main body and said roll support are of a one-piece construction formed from a flat blank in which said main body, said first section and said second section are longitudinally adjacent portions of said blank, and a fold crease extending between said upper and said lower end of said main body.

2. The invention as defined in claim 1 wherein said main body and said roll support are made of cardboard.

3. The invention as defined in claim 1 wherein said at least one tab comprises a pair of tabs extending outwardly from opposite sides of said main body.

4. The invention as defined in claim 3 wherein said tabs are aligned with each other.

5. The invention as defined in claim 1 wherein said second section of said roll support is fixedly secured to said main body by an adhesive.

6. A display holder for a tubular cylindrical roll comprising:

an elongated planar main body constructed of a flexible material, said main body having an upper end and a lower end, said ends being spaced apart from each other, a roll support having a first section pivotally attached to said lower end of the main body and a second section extending between and fixedly secured to said first section and fixedly secured said main body at a position intermediate said upper and lower ends of said main body so that said first section, said second section and a portion of said main body form a collapsible loop, said roll support being pivotal between an operable position and a collapsed position, wherein in said operable position said roll support extends laterally outwardly from said main body while in said collapsed position said roll support flatly abuts against said main body, at least a portion of said roll support first section having a width greater than the predetermined inside diameter of the roll, said main body having at least one outwardly extending tab adjacent said upper end of said main, body, said at least one tab being spaced from said lower end of said main body by at least the predetermined axial length of the roll, wherein said main body and said roll support are of a one-piece construction formed from a flat blank in which said main body, said first section and said second section are longitudinally adjacent portions of said blank, and a fold crease extending between said upper and said lower end of said main body.

7. The invention as defined in claim 6 wherein said main body and said roll support are made of cardboard.

8. The invention as defined in claim 6 wherein said at least one tab comprises a pair of tabs extending outwardly from opposite sides of said main body.

9. The invention as defined in claim 8 wherein said tabs are aligned with each other.

* * * * *